United States Patent [19]

McCoy

[11] Patent Number: 5,059,067

[45] Date of Patent: Oct. 22, 1991

[54] METHOD FOR FORMING A CURVED INTERIOR PROFILE TO A CEMENTITIOUS MATERIAL

[76] Inventor: James M. McCoy, 11249 North Oriole La., Mequon, Wis. 53092

[21] Appl. No.: 430,521

[22] Filed: Nov. 1, 1989

[51] Int. Cl.[5] ..... B05D 3/12; B28B 19/00; B29C 41/08; E04B 1/16

[52] U.S. Cl. ..... 405/268; 52/169.7; 52/742; 52/743; 118/105; 249/10; 249/DIG. 3; 264/32; 264/33; 264/34; 264/35; 264/269; 264/309; 264/312; 425/59; 425/458; 425/460; 427/356

[58] Field of Search ..... 264/31-35, 264/269, 309, 312, 333, 310; 118/105; 427/356; 405/268, 150, 151, 142, 146, 53; 249/DIG. 3, 11, 10, 19, 20; 425/63, 59, 470, 458, 457, 460, 427; 52/169.7, 741, 742, 743; 4/506, 513

[56] References Cited

U.S. PATENT DOCUMENTS

| | | | |
|---|---|---|---|
| 1,297,082 | 3/1919 | Brown | 425/59 X |
| 1,995,692 | 3/1935 | Urschel | 425/63 |
| 2,435,052 | 1/1948 | Parrett | 264/32 |
| 2,520,199 | 8/1950 | Butcher | 425/59 |
| 3,074,139 | 1/1963 | Gay | 264/33 |
| 3,355,897 | 12/1967 | Mullen, Jr. | 405/268 |
| 3,597,932 | 8/1971 | Sebastian | 405/268 X |
| 3,649,727 | 3/1972 | Gauger | 264/312 X |
| 3,810,441 | 5/1974 | Padgett et al. | 118/105 |
| 3,897,182 | 7/1975 | Heinzle | 249/20 X |
| 4,298,555 | 11/1981 | Weltmer | 264/31 |
| 4,340,553 | 7/1982 | Fosse | 264/312 X |
| 4,371,325 | 2/1983 | Harbison | 425/63 |
| 4,600,548 | 7/1986 | Nenna | 264/261 X |
| 4,631,867 | 12/1986 | Reed | 264/32 X |
| 4,690,631 | 9/1987 | Haddy | 425/460 X |

*Primary Examiner*—Jan H. Silbaugh
*Assistant Examiner*—Karen Aftergut
*Attorney, Agent, or Firm*—Andrus, Sceales, Starke and Sawall

[57] ABSTRACT

A method for forming cementitious material, such as gunite or the like, to a desired cross-sectional profile for an interior structure such as a swimming pool, skateboard bowl or the like. A forming assembly includes a cutting edge, which is formed so as to correspond to the final desired profile of the structure. The forming assembly is mounted so as to be pivotable about a pivot axis substantially coincident with the center of the structure being formed. In this manner, when the cementitious material is applied to the side walls and bottom of the excavation to a depth slightly greater than that as finally desired, and the forming assembly pivoted 360° about its pivot axis, the final desired cross-sectional profile of the structure is attained due to the action of the forming assembly striking off the excess material applied to the excavation.

10 Claims, 2 Drawing Sheets

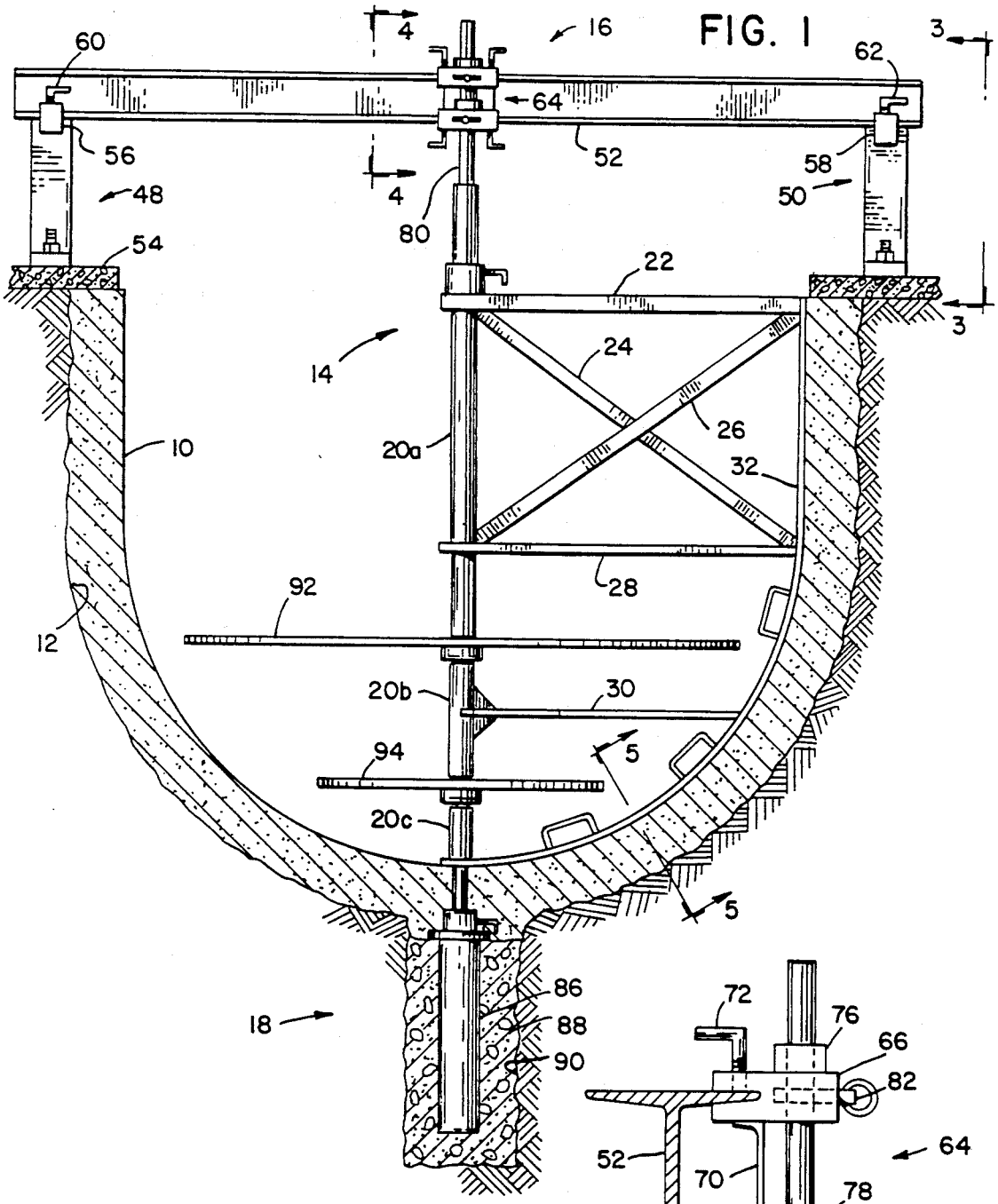
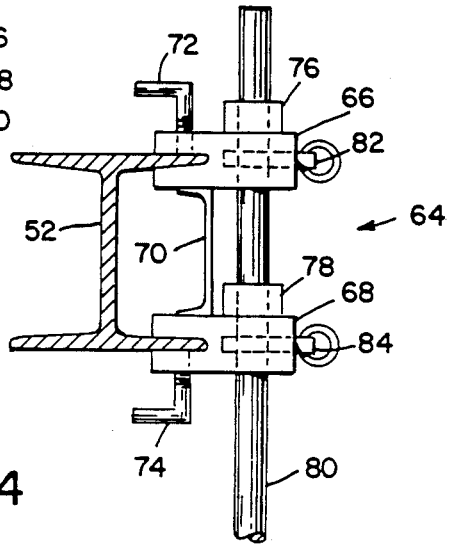
FIG. 4

FIG. 2
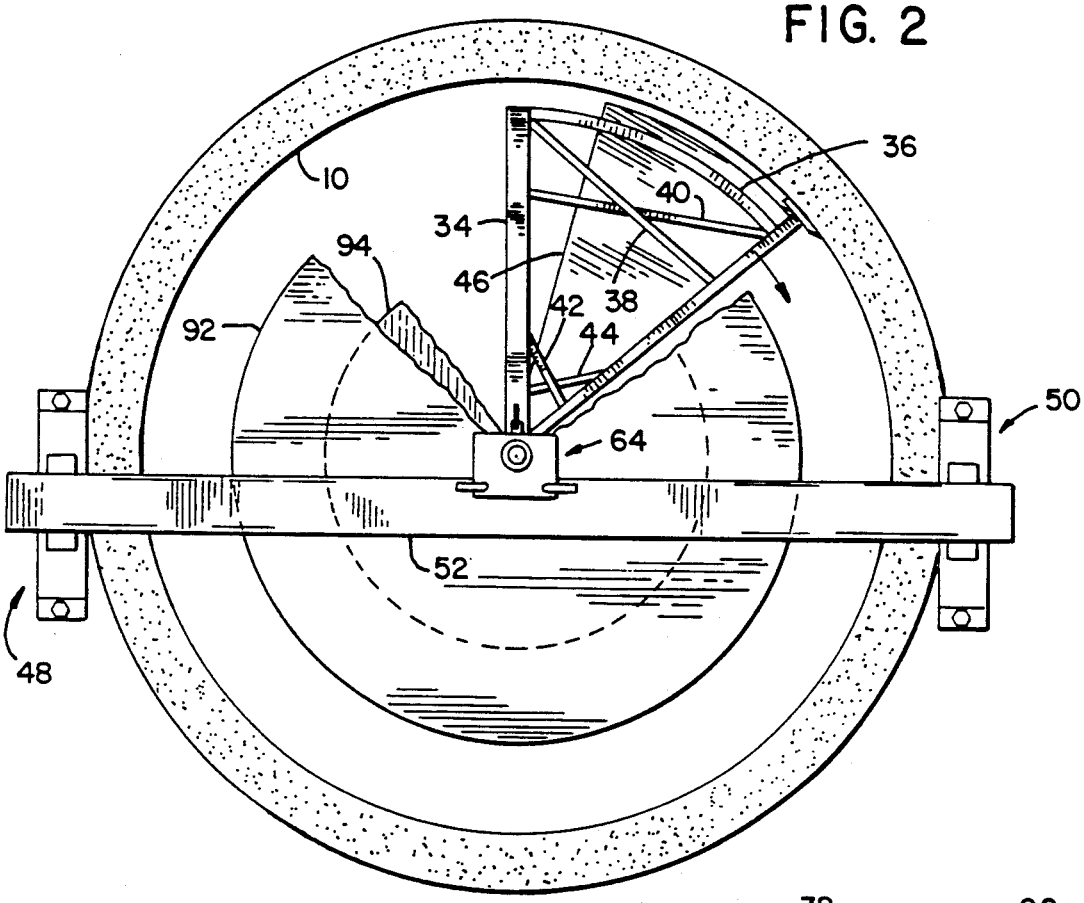
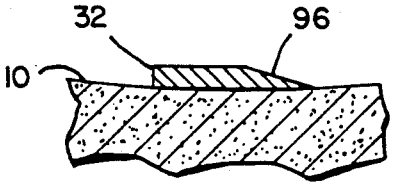
FIG. 5
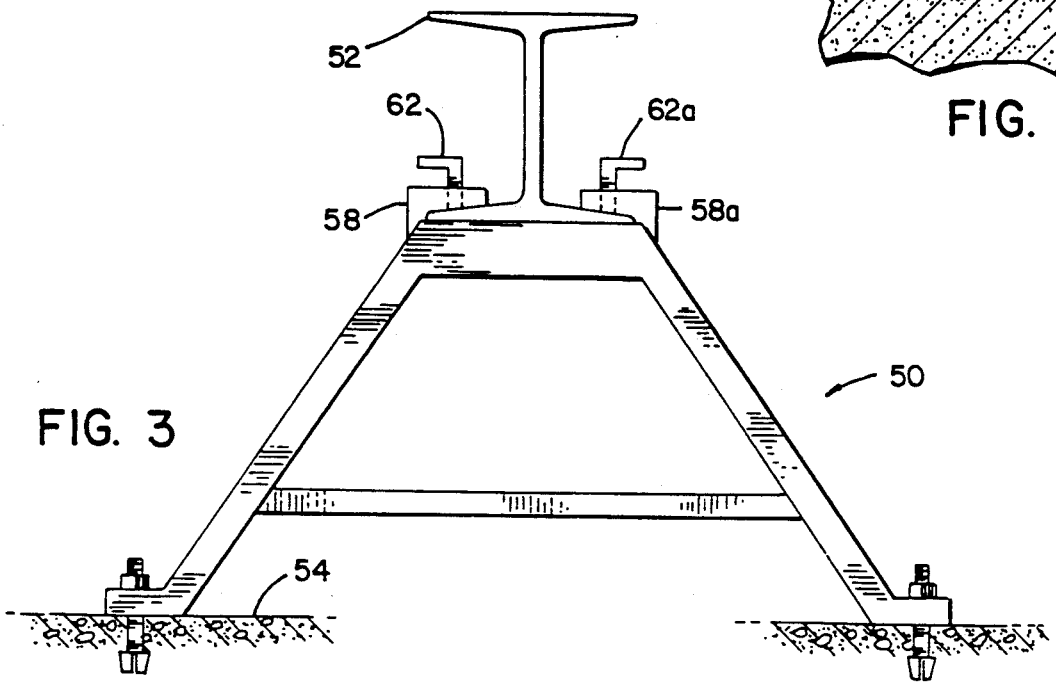
FIG. 3

METHOD FOR FORMING A CURVED INTERIOR PROFILE TO A CEMENTITIOUS MATERIAL

BACKGROUND AND SUMMARY

This invention relates to construction equipment, and more particularly construction equipment of the type used to form a cementitious material to a desired profile.

In certain construction projects, it is necessary to form a cementitious material such as concrete, gunite or the like to a desired interior profile. Projects of this type include swimming pools or artificial ponds. Additionally, in recent years skateboarding "bowls" have become increasingly popular, and also entail forming gunite to a desired interior profile In an application such as this, it is very important that the surface of the bowl be very smooth and not have any ripples, ridges or the like which interfere with the skateboard ride.

In the past, it has been known to form an interior structure such as a swimming pool, skateboard bowl or the like by first forming an excavation having an interior profile roughly corresponding to the desired final interior profile of the structure. A large number of pins or pegs are driven into the bottom and side walls of the excavation, with the pegs being driven such that the outer end of each peg is at a predetermined location corresponding to a point on the desired interior profile of the structure. A cementitious material such as gunite or the like is then sprayed onto the side walls and bottom of the excavation, and the outer ends of the pegs are used as screeds for hand-forming the gunite to its desired final cross-sectional shape.

There are numerous drawbacks to the above-described method of forming an interior structure. For one, the method is extremely slow, time consuming and labor intensive. Additionally, even with great care and attention, tradesmen placing the pegs and forming the gunite using the pegs as screeds are necessarily limited by available tools and materials, and it is difficult, if not impossible, to form a structure having a ridge-free and ripple-free interior surface.

The present invention is designed to provide an apparatus and method for relatively quickly and efficiently forming an interior structure having a smooth and continuous interior surface.

In accordance with the method of the invention, an excavation is formed providing a bottom and one or more side walls extending upwardly therefrom. An interior forming assembly is provided, which has an inner end and a forming edge disposed towards its outer end. The forming assembly is placed into the excavation, and the inner end of the forming assembly is fixed relative to the excavation along a pivot axis substantially coincident with the center of the desired curved final interior surface of the structure. A wet cementitious material is applied to the side walls and bottom of the excavation, with the thickness of the material as applied being greater than the desired final thickness of the walls of the structure. The forming assembly is then pivoted about its pivot axis, whereby the forming edge of the forming assembly forms the cementitious material to its desired curved interior profile. The forming edge of the forming assembly preferably includes a surface for forming the cementitious material applied to the excavation side wall as well as that applied to the excavation bottom. The step of fixing the inner end of the forming assembly preferably comprises providing an axially extending member, securing the member at a first point toward the bottom of the excavation, and securing the member at a second point spaced above the bottom of the excavation. In this manner, when the axially extending member is secured, the member is substantially coincident with the center of the desired curved interior profile. The forming assembly is then mounted to the axially extending member for pivoting movement thereon. This method is advantageously employed when the forming assembly is pivoted about its entire range of movement about its pivot axis, so as to define a substantially circular interior shape to the cementitious material.

In accordance with another aspect of the invention, an apparatus is provided for forming a cementitious material to an arcuate interior profile, the material being applied to one or more side walls of an excavation. The apparatus comprises forming means having an inner end and a forming edge disposed towards its outer end. The forming means is adapted for placement into the excavation. Means is provided for fixing the inner end of the forming means relative to the excavation such that the forming means is pivotable about a pivot axis substantially coincident with the center of the desired final interior shape of the structure. The forming means is pivotable about its pivot axis such that the forming edge of the forming means acts to form the cementitious material on the side walls of the excavation to its desired cross-sectional profile during pivoting movement of the forming means about the pivot axis.

BRIEF DESCRIPTION OF THE DRAWINGS

The drawings illustrate the best mode presently contemplated of carrying out the invention.

In the drawings:

FIG. 1 is a cross-sectional elevation view showing the apparatus of the invention as installed in an excavation having a cementitious material applied to its side walls and bottom;

FIG. 2 is a top plan view of the apparatus of FIG. 1;

FIG. 3 is an end elevation view of the upper end of the apparatus, reference being made to line 3—3 of FIG. 1;

FIG. 4 is a sectional view taken generally along line 4—4 of FIG. 1; and FIG. 5 is a partial sectional view taken generally along line 5—5 of FIG. 1.

DETAILED DESCRIPTION OF THE PREFERRED EMBODIMENT

FIG. 1 shows an interior structure, such as a skateboarding bowl, formed of a wet cementitious material shown at 10 applied to the interior walls and bottom of an excavation, shown at 12. As shown, excavation 12 is generally in the form of a hemispherical bottom portion with a substantially vertical side wall extending therefrom to the upper surface of the excavation. Excavation 10 is formed so as to roughly correspond to the desired final cross-sectional interior profile of the bowl, but being deeper and wider than the finished interior profile thereof.

The cementitious material, shown at 10, which is applied to the excavation side walls and bottom may be that such as is known as gunite, which is a wet mixture of sand, water and cement commonly used for forming swimming pools and the like. The material is typically sprayed directly onto the side walls and bottom of the excavation.

In accordance with the invention, an apparatus for forming material 10, and a method for use in connection therewith, includes a forming assembly 14 mounted to an upper support assembly 16 and a lower support assembly 18.

Forming assembly 14 generally includes a center post section, shown at 20*a*, 20*b* and 20*c*. Support members shown at 22, 24, 26, 28 extend from post section 20*a*, and a support member 30 extends from section 20*b*. Support members 22–30 are connected at their outer ends to an outer forming member 32.

Forming member 32 is provided with a curved bottom portion and a straight upper portion, which provides a cross-sectional profile corresponding to the desired final cross-sectional profile of the interior structure to be formed.

Referring now to FIG. 2, it is seen that forming assembly 14 further includes a lateral bracing system including a rearward bracing member 34, an arcuate outer brace member 36 and a series of cross braces shown at 38, 40 and 42, 44. A waste collector tray 46 is connected to and movable with forming assembly 14, and is disposed at the bottom of forming assembly 14.

Upper support assembly 16 includes a pair of side support assemblies shown generally at 48, 50, between which extends a cross-beam 52. Side supports 48, 50 are adapted for connection to a concrete slab or the like, shown at 54, which is formed about the upper surface of the structure. Side supports 48, 50 are connected to slab 54 such as by anchor bolts or the like. It is understood that side supports, 48, 50 may also be anchored in any other manner satisfactory so as to secure them in a substantially rigid fashion relative to excavation 12.

Each of side supports 48, 50 includes a pair of clamping members, such as shown at 56, 58 respectively. Clamping members 56, 58 are engagable with the bottom web of cross-beam 52 by means of threaded clamping screws, shown at 60, 62, respectively. As shown in FIG. 3, with reference to side support 50, clamping member 58 is provided on one side of side support 50, while a like clamping member shown at 58*a* is provided on the other side of side support 50. In this manner, both sides of the bottom web of cross-beam 52 are secured to side support 50.

Clamping members 56, 58 are preferably constructed such that the elevation of the ends of cross-beam 52 can be varied relative to side supports 48, 50. In this manner, the exact desired elevation of cross-beam 52 relative to excavation 12 can be attained.

A variable position clamping assembly, shown generally at 64, is mountable to the upper and lower webs of cross-beam 52. Referring to FIG. 4, assembly 64 includes an upper member 66, a lower member 68, and a channel member 70 disposed therebetween. Each of upper and lower members 66, 68 is provided with a groove in its left side, which is adapted to receive the upper and lower webs, respectively, of cross-beam 52. A threaded member 72 is provided in upper member 66 for clamping upper member 66 to the upper web of beam 52. Likewise, a threaded member 74 is provided in lower member 68 for securing lower member 68 to the lower web of cross-beam 52. In this manner, the longitudinal position of assembly 64 on beam 52 can be fixed as desired.

Upper and lower members 66, 68 are fitted with bushings 76, 78, respectively. Bushings 76, 78 are adapted to receive the upper end of a pivot shaft, shown at 80. A pair of pins 82, 84 extend through pivot shaft 80 fixing its position relative to upper and lower members 66, 68.

Forming assembly 14 is mounted to pivot shaft 80 such that pivot shaft 80 extends through the central passage of center post sections 20*a*, 20*b* and 20*c*, and is pivotable on pivot shaft 80. The longitudinal axis of pivot shaft 80 thus defines the longitudinal axis of the structure being formed, and is thus placed within excavation 12 such that it is substantially vertical and oriented substantially symmetrically relative to the side walls and bottom of excavation 12.

Lower support assembly 18, in which the lower end of pivot shaft 80 is fixed relative to excavation 12, includes an anchor tube 86 embedded within concrete 88 placed within a hole 90. Hole 90 is dug so as to extend along, and be substantially coincident with, the center of the excavation. Concrete 88 is poured in hole 90, and tube 86 is positioned such that its longitudinally extending passage is oriented substantially vertical and is coincident with the center of the final desired shape of the interior structure.

As shown, the lower end of pivot shaft 80 is adapted to be received within the passage of tube 86. In this manner, upon placement of pivot shaft 80 within tube 86 and through bushings 76, 78 provided in upper clamping assembly 64 and proper positioning thereof on cross-beam 52, pivot shaft 80 defines the central longitudinal axis of the interior structure.

A pair of work platforms, shown at 92, 94, are stationarily mounted to pivot shaft 80. Platforms 92, 94 act to support one or more workers during forming of the interior structure, as will be explained.

FIG. 5 shows cutter member 32 in greater detail, illustrating a beveled cutting edge 96.

In operation, the above-described apparatus functions as follows. After excavation 12 has been formed to a satisfactory shape roughly corresponding to the final desired shape and cross-sectional profile of the interior structure, hole 90 is dug and tube 86 anchored thereto by concrete 88, as shown. Care must be taken to ensure that tube 88 is oriented substantially vertical, and that its passage within which pivot shaft 80 is received is in the proper location corresponding to the center of the structure. Side supports 48, 50 are then installed above excavation 12 and cross-beam 52 mounted to side supports 48, 50. Forming assembly 14 is then mounted to pivot shaft 80 with the various components of forming assembly 14 in their position as shown in FIG. 1. The combination of the forming assembly and pivot shaft is then lowered into excavation 12 and the lower end of pivot shaft 80 is placed within the passage of tube 86. The upper end of pivot shaft 80 is then assembled to clamping assembly 64, which is placed to its proper position relative to cross-beam 52 and clamped thereon for retaining pivot shaft 80 and forming assembly 14 in position.

After forming assembly 14 and pivot shaft 80 are in place, material 10, such as gunite or the like, is applied to the side walls and bottom of excavation 12 to a depth slightly greater than that required for the final profile of the structure. One or more workers, utilizing platforms 92, 94, and personnel located above excavation 12 on the ground, cause forming assembly 14 to be pivoted on pivot shaft 80. This pivoting of forming assembly 14 about pivot shaft 80 allows beveled cutting edge 96 of cutter member 32 to strike off the gunite extending beyond the final desired depth, and in the process forming the outer surface of the gunite layer to the final desired cross-sectional profile, which corresponds to the shape of cutter member 32. One full complete revolution of forming assembly 14 about pivot shaft 80 results in forming of the entire interior of the structure.

During pivoting movement of forming assembly 14 about pivot shaft 80 and striking off of the excess gunite, the excess or waste will be deposited into waste tray 46, for ultimate disposal.

After the structure has been formed, forming assembly 14 and shaft 80 are removed from excavation 12, and mounting tube 86 is left in place. This results in a hole in the bottom of the structure, which is easily patched after material 10 has dried and cured. Side supports 48, 50 and beam 52 are then removed.

While the invention has been described with reference to a particular embodiment and application, it is understood that various details can be changed without departing from the spirit and scope of the invention. For example, any shape could be provided to cutter member 32 according to the desired cross-sectional profile of the final structure being formed. Additionally, it is possible to employ the apparatus and method of the invention in applications where less than a completely circular interior structure is being formed. For example, in a swimming pool corner, it may be that forming the corner with the structure and apparatus of the invention may be quicker and easier than prior art methods.

Various alternatives and embodiments are contemplated as being within the scope of the following claims, particularly pointing out and distinctly claiming the subject matter regarded as the invention.

What is claimed is:

1. A method of providing a substantially circular interior shape to a cementitious material placed within an excavation to form an interior structure in the excavation comprising the steps of:

forming an excavation with a bottom and a peripheral side wall extending upwardly therefrom;

providing an interior forming assembly having an inner end and an outer forming edge corresponding to the desired cross-sectional profile of said interior structure, said outer forming edge having an upper end and a lower end and including an arcuate portion toward said lower end;

placing said forming assembly into said excavation such that said lower end of said forming edge is located adjacent said bottom of said excavation;

fixing said inner end of said forming assembly relative to said excavation such that said inner end of said forming assembly is fixed along a pivot axis substantially coincident with the center of said excavation in which said interior structure is formed;

applying said cementitious material to said bottom and said peripheral side wall of said excavation such that the outer surface of said cementitious material roughly corresponds to the final desired cross-sectional profile of said cementitious material; and then pivoting said forming assembly about said pivot axis such that said forming edge of said forming assembly provides said cementitious material with said final desired cross-sectional profile, including an arcuate portion toward said bottom of said excavation, which arcuate portion is formed by said arcuate portion of said forming edge, thereby forming said interior structure in said excavation with said desired cross-sectional profile.

2. A method of providing an arcuate interior profile to a cementitious material placed with an excavation to form an interior structure substantially circular in plan in the excavation, comprising the steps of:

forming an excavation providing a bottom and a peripheral side wall extending upwardly therefrom;

applying a cementitious material to said peripheral side wall and said bottom of said excavation such that the outer surface of said cementitious material roughly corresponds to the final desired cross-sectional profile of said cementitious material;

providing an interior forming assembly having an inner end and an outer end, and a forming edge disposed at said outer end, with said forming edge having an upper end and a lower end and including an arcuate portion toward said lower end;

placing said forming assembly into said excavation such that said lower end of said forming edge is located adjacent said bottom of said excavation;

fixing said inner end of said forming assembly relative to said excavation such that said inner end of said forming assembly is fixed along a pivot axis substantially coincident with the center of said excavation in which said interior structure is formed; and then pivoting said forming assembly about said pivot axis, whereby said forming edge of said forming assembly provides said cementitious material with said interior profile, including an arcuate portion adjacent said bottom of said excavation formed by said arcuate portion of said forming edge, such that said interior structure is formed in said excavation during said pivoting of said forming assembly about said pivot axis.

3. The method of claim 2, wherein the step of fixing said inner end of said forming assembly comprises:

providing an axially extending member;

securing said axially extending member at a first point toward said bottom of said excavation;

securing said axially extending member at a second point spaced above said bottom of said excavation;

such that, when said axially extending member is secured, said member is substantially coincident with said center of said excavation in which said interior structure is formed; and mounting said forming assembly to said axially extending member for pivoting movement thereon.

4. The method of claim 3, wherein said axially extending member comprises a center post, and wherein the step of securing said axially extending member at said first point toward said bottom of said excavation comprises:

providing a rigid mounting structure at said bottom of said excavation including an axial passage coincident with said center of said excavation in which said interior structure is formed;

placing an end of said post into said passage of said rigid mounting structure; and securing said post to said rigid mounting structure.

5. The method of claim 4, wherein the step of providing a rigid mounting structure comprises:

forming a downwardly extending passage at said bottom of said excavation;

placing a tubular member including a post-receiving passage into said downwardly extending passage; and anchoring said tubular member into said passage by placing concrete into said passage around said tubular member.

6. The method of claim 3, wherein said axially extending member comprises a center post, and wherein the step of securing said axially extending member at said second point spaced above said bottom of said excavation comprises:

providing an upper support member spaced above the top of said excavation; and fixing the upper end of said center post to said upper support member.

7. The method of claim 6, wherein the step of providing an upper support member comprises:

providing a beam having a length greater than the transverse dimension of said excavation; and rigidly fixing said beam above said top of said excavation to a pair of supports provided one on each side of said excavation.

8. The method of claim 7, further comprising the step of providing releasable connections between said beam and said pair of supports so that said beam is transversely longitudinally adjustable relative to said excavation.

9. The method of claim 6, wherein the step of fixing said center post to said upper support member comprises mounting said upper end of said center post to said support member such that said upper end of said post is transversely movable to varying horizontal positions on said support member relative to said excavation, and fixing said upper end of said center post to said support member when the desired horizontal position of said center post is attained.

10. The method of claim 2, wherein the step of pivoting said forming assembly about said pivot axis comprises pivoting said forming assembly about the entire range of pivoting movement of said forming assembly so as to define a substantially circular interior shape to said cementitious material to form said structure.

* * * * *